United States Patent [19]
Marino

[11] 3,934,502
[45] Jan. 27, 1976

[54] ADJUSTABLE ROTARY SCREEN PRINTER WITH AIR-BIASED SQUEEGEES

[75] Inventor: Thomas J. Marino, Totowa, N.J.

[73] Assignee: Morrison Machine Co., Paterson, N.J.

[22] Filed: Dec. 31, 1974

[21] Appl. No.: 537,649

Related U.S. Application Data

[63] Continuation-in-part of Ser. No. 326,396, Jan. 24, 1973, abandoned.

[52] U.S. Cl. ..... 101/115; 101/116; 101/119
[51] Int. Cl.² ..... B41F 15/10; B41F 15/42
[58] Field of Search ..... 101/115, 116, 119, 120, 101/123, 124, 169, 365; 15/256.5, 256.51

[56] References Cited

UNITED STATES PATENTS

| | | | |
|---|---|---|---|
| 1,566,358 | 12/1925 | White | 101/119 X |
| 3,098,434 | 7/1963 | Lime | 101/178 |
| 3,116,688 | 1/1964 | Ward, Jr. et al. | 101/365 X |
| 3,163,109 | 12/1964 | Stelling, Jr. | 101/178 X |
| 3,186,339 | 6/1965 | Turner et al. | 101/169 |
| 3,456,584 | 7/1969 | Moskowitz | 101/119 |
| 3,604,350 | 9/1971 | Rosenstat | 101/248 X |
| 3,630,145 | 12/1971 | Leuenberger | 101/248 |
| 3,685,442 | 8/1972 | Harwell, Jr. | 101/119 |
| 3,718,086 | 2/1973 | Vertegaal | 101/120 X |
| 3,735,730 | 5/1973 | Mitter | 101/119 X |

*Primary Examiner*—Edgar S. Burr
*Assistant Examiner*—R. E. Suter
*Attorney, Agent, or Firm*—Lerner, David, Littenberg & Samuel

[57] ABSTRACT

A screen printing machine which includes a frame, a backing member supported by the frame, and at least one rotary screen assembly carried by the frame in adjustable relationship with respect to the backing member. Each rotary screen assembly includes an inner elongated support member, an outer hollow screen rotatably supported about the inner elongated support member for rotation thereabout, and elongated applicator means which engages the inner surface of the hollow screen and which is supported by the elongated inner support means. Pressure adjusting means are carried within the interior of the hollow screen, comprising a plurality of individually inflatable elongated tubes positioned behind the elongated applicator means. In one embodiment, the outermost tubes extend beyond the extremities of the applicator means.

Various adjusting capabilities are provided, including first adjusting means for rotating the inner elongated support member about its own axis from a location outside of the associated hollow screen. Second adjusting means are provided for effecting longitudinal motion of the inner elongated support member of the rotary screen with respect to the frame. Additionally, third adjusting means are provided for effecting circumferential movement of the inner support member with respect to the backing drum.

23 Claims, 8 Drawing Figures

ADJUSTABLE ROTARY SCREEN PRINTER WITH AIR-BIASED SQUEEGEES

RELATIONSHIP TO OTHER APPLICATIONS

This application is a continuation-in-part of U.S. application 326,396, filed Jan. 24, 1973 now abandoned.

BACKGROUND OF THE INVENTION

Rotary screen printing machines are well known and typically include a frame, backing means supported by the frame, and at least one, and usually a plurality, or rotary screen assemblies which are carried by the frame in adjustable relationship with respect to the backing means. Typically, each rotary screen assembly includes an inner elongated member, an outer hollow patterned screen supported about the inner elongated support member for rotation thereabout, and an elongated applicator, such as a conventional squeegee, which is supported on the elongated support member and engages the inner surface of the screen to press the coloring paste or ink through the perforated pattern thereof as the fabric being printed is passed between the respective hollow screen and the backing means. In a rotary type screen printing machine, the backing means comprises a large drum and the plurality of rotary screen assemblies are supported circumferentially thereabout. In a flat bed screen printing machine, it is normal practice to provide the rotary screen assemblies in a common plane with each screen assembly being provided with a cooperating back-up roller associated therewith.

Since the pressure of the applicator (i.e., squeegee) plays such an important role in controlling the quality of the printing, various prior art techniques have been suggested for permitting adjustment of the squeegee with respect to the inner surface of the screen. For example, U.S. Pat. Nos. 3,196,784; 3,216,349, 3,566,784; 3,592,132; and 3,596,595 disclose magnetic attraction techniques for selectively drawing the squeegee into contact with the interior surface of the screen. As another approach, U.S. Pat. Nos. 2,928,340 and 3,186,339 disclose the use of fluid actuated pistons which are connected to the squeegee to be controlled thereby. As another approach, U.S. Pat. Nos. 2,292,602; 2,571,064; and 3,229,624 employ springs to bias the squeegee against the interior surface of the screen.

More recently, it has been suggested to employ an elongated inflatable tube to control the pressure of the squeegee against the inner surface of the printing screen. In this prior art device, an inflatable tube corresponding to the length of the printing screen is supported on the inner support shaft of the rotary screen assembly and located behind the squeegee member. By controlling the inflation of the tube, the amount of squeegee pressure against the inner surface of the screen may be varied. As will be pointed out below, an important aspect of the instant invention is to provide an improvement over this type of squeegee pressure adjustment technique.

It has also been appreciated with respect to the above-described type of screen printing machine that it is desirable to provide an adjusting mechanism for varying the angle at which the squeegee engages the inner surface of the screen. In prior art machines, however, such adjustment can only be accomplished by removing the hollow screen so as to expose the squeegee and the mechanism for varying the angular position thereof. In addition, such adjusting mechanism of the prior art machines has been rather complex.

Similarly, prior art machines have been provided with adjusting mechanisms for varying the position of the screen of each rotary screen assembly with respect to its associated backing member. Unfortunately, the various techniques provided in the prior art machines are rather complex and no simple mechanism has been developed to provide all the desired degrees of motion of the screen. As noted below, a section aspect of the invention is to provide a screen printing machine with improved mechanisms for achieving the various desirable movements of the screens with respect to their associated backing member.

SUMMARY OF THE INVENTION

With respect to that aspect of the invention directed to controlling the squeegee pressure, the instant invention provides that in a screen printing machine of the aforedescribed type, the pressure adjusting means carried in the interior of the hollow screen of each rotary screen assembly comprises a plurality of individually inflatable elongated tubes positioned behind the applicator means. In most simple manner, selected amounts of pressure may be applied to selected portions of the applicator. Of course, it will be appreciated that the number and length of such portions will correspond to the number and length of inflatable tubes employed.

It should be noted that this system of selective pressure application to various portions along the length of the squeegee has been found to be particularly advantageous in printing machines of this type which are especially wide. That is, it has been found that the wider the machine, and the longer the rotary screen assembly, the more there is a tendency for the screen to bow away from its respective backing member near the center thereof. This occurs because the rotary screen assembly is supported with respect to the frame at its opposite ends thereof; and with a relatively long rotary screen assembly, there is no fixed support provided at the center thereof. With the instant invention, by inflating the centrally located inflatable tube or tubes at a greater pressure than the inflatable tubes located adjacent the ends of the squeegee, the increased pressure at the center of the squeegee will compensate for the bowing effect which naturally occurs.

With respect to that aspect of the invention directed to selecting the angle of squeegee engagement with the inner surface of the respective screen, the instant invention provides extremely simple adjustment means which are located externally of the rotary screen assembly such that the squeegee angle can be varied without removing the hollow screen from the assembly.

Finally, with respect to that aspect of the instant invention directed to improving the ability to adjust the rotary screen with respect to its backing member, simple, novel adjustment means are provided for effecting longitudinal movement of the hollow screen with respect to its associated backing member as well as for providing circumferential movement of the hollow screen with respect to its associated backing member.

DETAILED DESCRIPTION OF THE DRAWINGS

Figure 1:
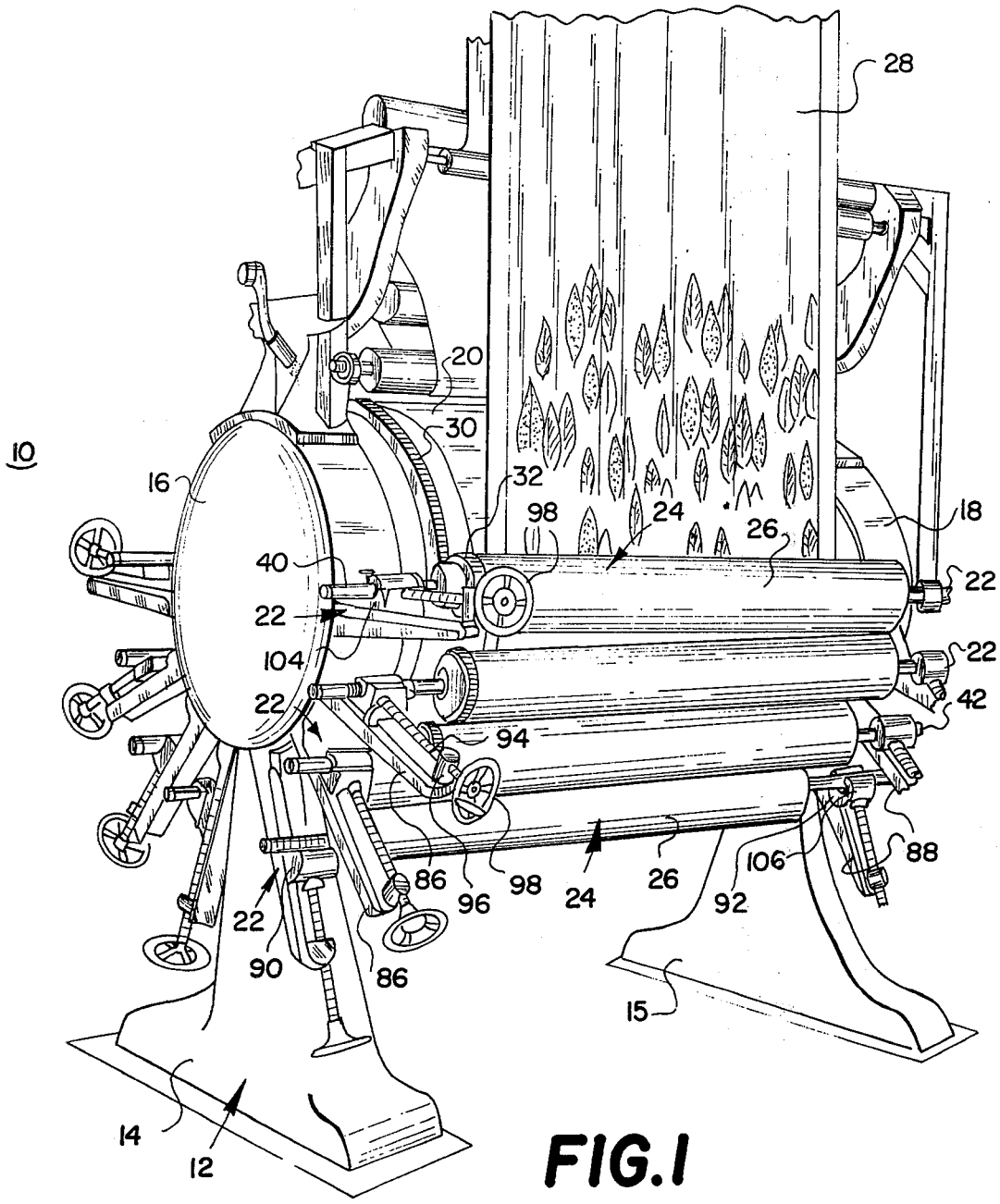
FIG. 1 is a perspective view of a screen printing machine constructed in accordance with the teachings of the instant invention.

Turning to the figures, there is shown in FIG. 1 a screen printing machine broadly designated 10. The machine 10 includes a frame 12 having side legs 14 and 15 which are provided at their respective upper ends thereof with circular end blocks 16 and 18 respectively. Journaled for rotation between the end blocks 16 and 18 is a backing drum 20. Supported circumferentially about the drum 20 by support arrangement broadly designated 22 which project out from the respective circular end blocks 16 and 18 are a plurality of identical rotary screen assemblies 24. The construction of the rotary assemblies 24 will be presented in further detail, but sufficient for present understanding, it is well known that such rotary screen assemblies include a hollow screen 26 having finely apertured patterns through which ink or coloring paste is forced by an internal squeegee arrangement so as to print corresponding patterns on the material 28 passing between the backing drum 20 and the rotary screen assemblies 24. In this connection, a sun gear 30 is rotatably supported on the same shaft (not shown) upon which the back-up drum 20 rotates, and the teeth of gear 30 engage corresponding teeth on gear 32 associated with each rotary assembly 24 whereby rotation of the drum 20 and the gear 30 cause corresponding rotation (but in opposite direction) of the screen 26.

Before turning to the specific improvements of the instant invention, it will be appreciated from the above discussion that the invention hereof is being illustrated in the environment of a rotary screen printing machine, that is one which includes the large rotating back-up drum assemblies 24. However, the invention hereof is not to be deemed limited to such environment since as it will become apparent, the principles hereof will be applicable to a conventional flat bed screen printing machine in which the plurality of rotary screen assemblies are located in the same plane and each is provided with an individually associated back-up roller.

Figure 2:
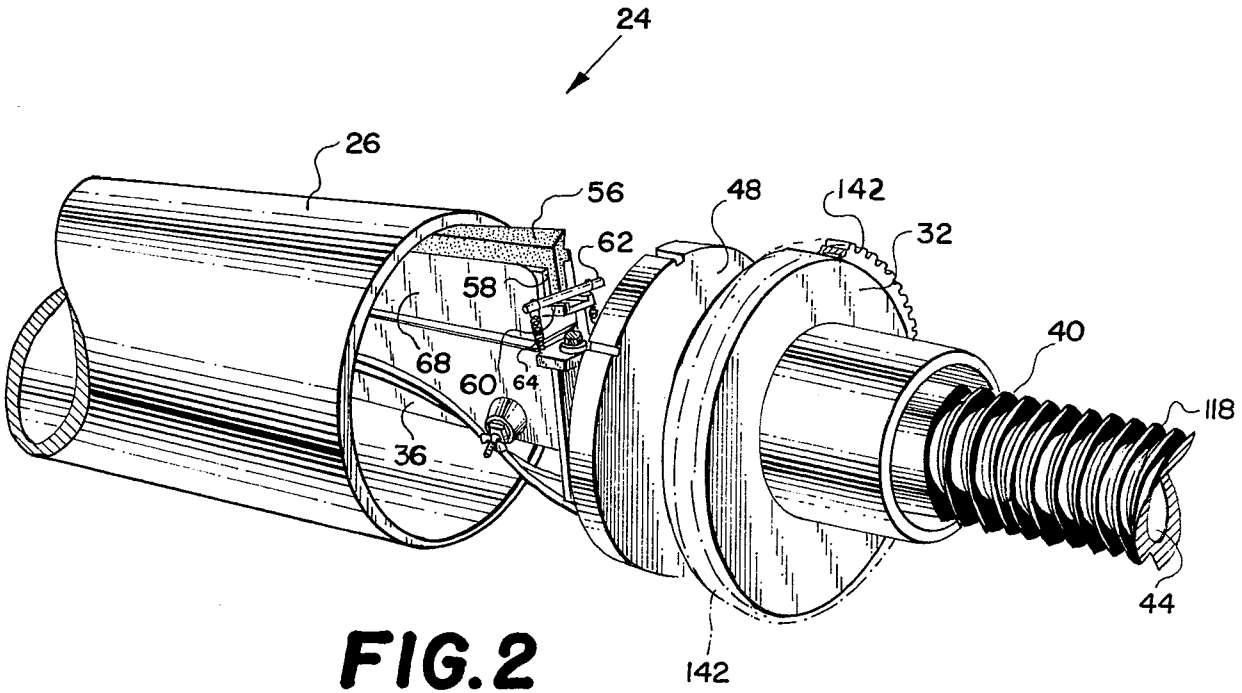
FIG. 2 is a partial, exploded, perspective view of a rotary screen assembly employed in the instant invention.
Figure 3:
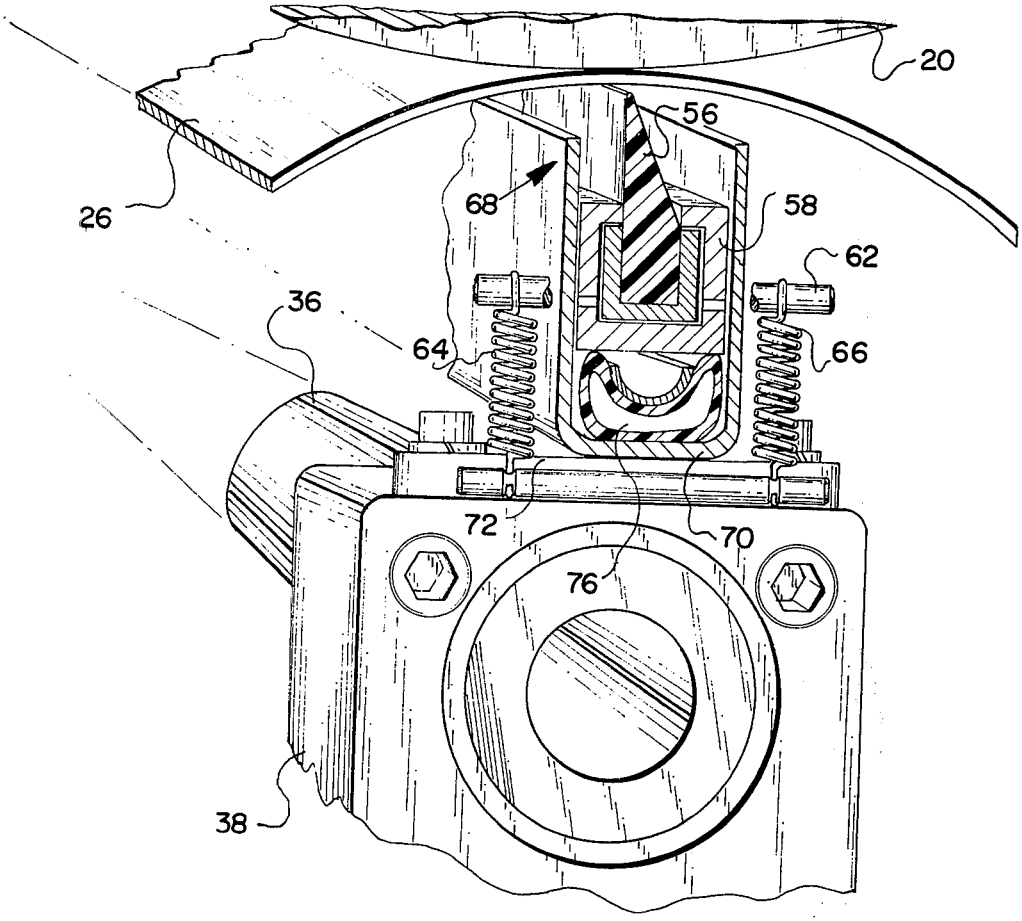
FIG. 3 is a perspective view, partly in section, of the rotary screen assembly shown in FIG. 2.
Figure 5:
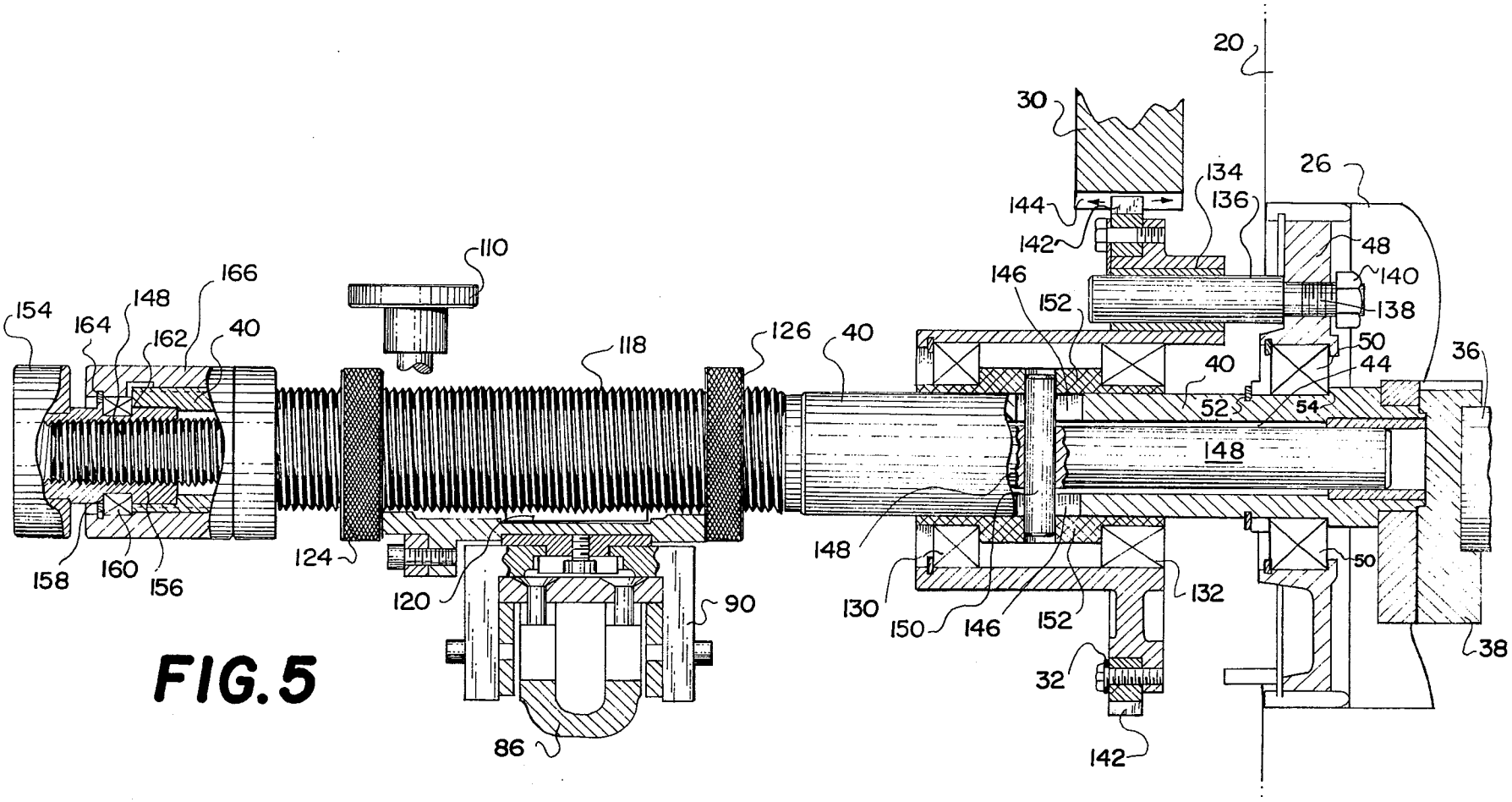
FIG. 5 is a partial elevational view of a portion of a novel rotary screen assembly hereof as well as a portion of the associated adjusting mechanism therefor.

Considering FIGS. 1, 2, 3, and 5, it will be seen that each rotary screen assembly 24 includes an inner elongated support member 36 provided at each end with a support block 38 (only one of which is visible in FIGS. 3 and 5). Extending from opposite ends of the inner elongated support member 36 are first and second hollow shaft members 40 and 42 respectively (the shaft member 42 being visible only in FIG. 1) which include a hollow interior 44, the purpose of which will be explained in greater detail. As seen in FIG. 5, the hollow screen 26 is freely rotatably supported with respect to the inner elongated support member 36 by being carried by a pair of circular end plates 48 (only one of which is shown in FIG. 5) which are freely rotatable with respect to the associated shaft member 40 (or 42 at the other end) with the aid of ball bearings 50. It will be appreciated that a retaining ring 52, together with a step portion 54 of the respective shaft 40 (or 42) prevents longitudinal motion of the end plate 48 while still permitting rotation thereof.

The inner elongated support member 36 supports an elongated applicator which in the illustrated embodiment is a conventional squeegee 56, the edge of which engages the inner surface of the screen 26 to force ink through the patterned regions provided therethrough. As best seen in FIGS. 2 and 3, the squeegee 56 actually protrudes from a generally rectangular squeegee holder 58 which at opposite ends thereof include outwardly directed lip portions 60 across which is disposed a bar 62 which is biased by springs 64 and 66 so as to normally urge the squeegee holder 58 together with the squeegee 56 in a downward position as viewed in FIGS. 2 and 3. The squeegee holder 58 is constrained to vertical motion by a generally U-shaped channel member 68, the bight portion 70 of which is appropriately secured on a supporting plate 72 carried by the end block 38 in turn carried by the inner elongated support member 36.

As is well known, the orientation is such that the point of engagement of the squeegee 56 with respect to the inner surface of the screen 26 is on the periphery of the back-up drum 20. In other words, with respect to FIG. 3, the squeegee lies perpendicular to the flow path of the fabric passing between the screen 26 and the back-up roller 20. (Of course, it has been suggested in the prior art that it is sometimes desirable to vary the angle at which the squeegee engages the inner surface of the screen 26; and in fact, to be subsequently described is a particularly advantageous feature of the instant invention by which the angle of the squeegee may be varied from a location outside of the screen 26).

Figure 4:
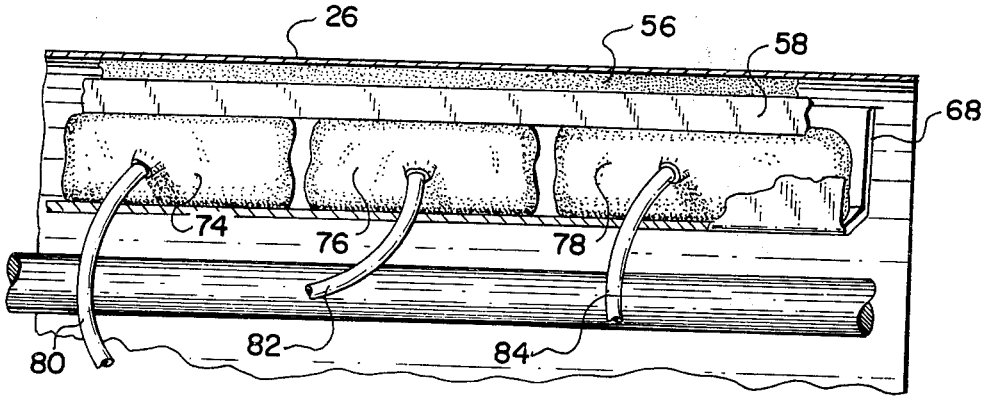
FIG. 4 is a side view, partially in perspective and partially in section illustrating the feature of the instant invention relating to the use of a plurality of elongated individually inflatable tubes for selectively appling pressure to different portions of the length of the squeegee shown therein.

In accordance with a particular advantageous feature of the invention, and with reference to FIGS. 3 and 4, novel pressure adjusting means are provided in the interior of the hollow screen by which the pressure applied to the squeegee 56 (and hence the pressure of engagement between the squeegee 56 and the interior of screen 26) may be selectively varied along the length thereof. Such pressure adjusting means comprises a plurality of individually inflatable elongated tubes 74, 76 and 78 positioned behind the squeegee holder 58 within the confines of the U-shaped channel member 68. Such inflatable tubes are constructed of rubber or similar elastic material and function much like individual elongated balloons. By suitable fluid or air conveying hoses 80, 82 and 84, respectively, and appropriate pressurizing means (such as a conventional compressor, not shown, appropriately valved to permit selective distribution of compressed fluid to the tubes 80, 82 and 84), the individual inflatable tubes 74, 76 and 78 may be selectively inflated to vary the pressure behind the squeegee along its length. As noted previously, this has been found particularly advantageous when dealing with wide screen printing apparatus wherein there is a tendency for the center of the rotary screen to slightly bow away from the associated back-up roller 20. With the instant invention one can compensate by inflating center tube 76 slightly more than the end tubes 74 and 76 thereby applying greater pressure behind the squeegee 56 along the center region thereof. Of course, the aforedescribed example is intended to merely illustrate the versatility of the plurality of selectively inflated tubes 74, 76 and 78 and the instant invention is not intended to be limited thereby. Indeed, the selective pressure along the length of the squeegee which is made possible by this aspect of the instant invention is very useful at all times to properly establish the proper squeegee pressure along its length and thereby properly control the flow of coloring paste or ink passing through the screen 26 into engagement with the fabric to be printed. Also, it is to be appreciated that although three such inflatable tubes 74, 76 and 78 have been illustrated in the instant application, any number of such tubes, greater than one, may be employed depending only upon the extent of selective control which is desirable for a particular application.

As noted previously, the instant invention further includes adjusting means for rotating the inner elongated support member 36 of each rotary screen assembly about its own axis from a location outside of the respective hollow screen 26 whereby the angle of the applicator means (i.e., angle of engagement of the squeegee 56) can be selectively varied from a location outside of such hollow screen. Thus, and as it will be best appreciated considering FIG. 1 together with FIGS. 6 and 7, it will be seen that for each rotary screen assembly 24, the frame includes a pair of outstanding projections 86 and 88 respectively. Slidably mounted on the projections 86 and 88 are saddles 90 and 92, respectively, which include forwardly extending screw threaded portions 94 which engage internally threaded passageways provided in outstanding studs 96 provided on the projections 86 and 88, respectively. On the screw threaded portions 94 are hand wheels 98 which may be rotated to cause the saddle 90 to travel inwardly or outwardly on the projections 86 with respect to the back-up drum 20.

Figure 6:
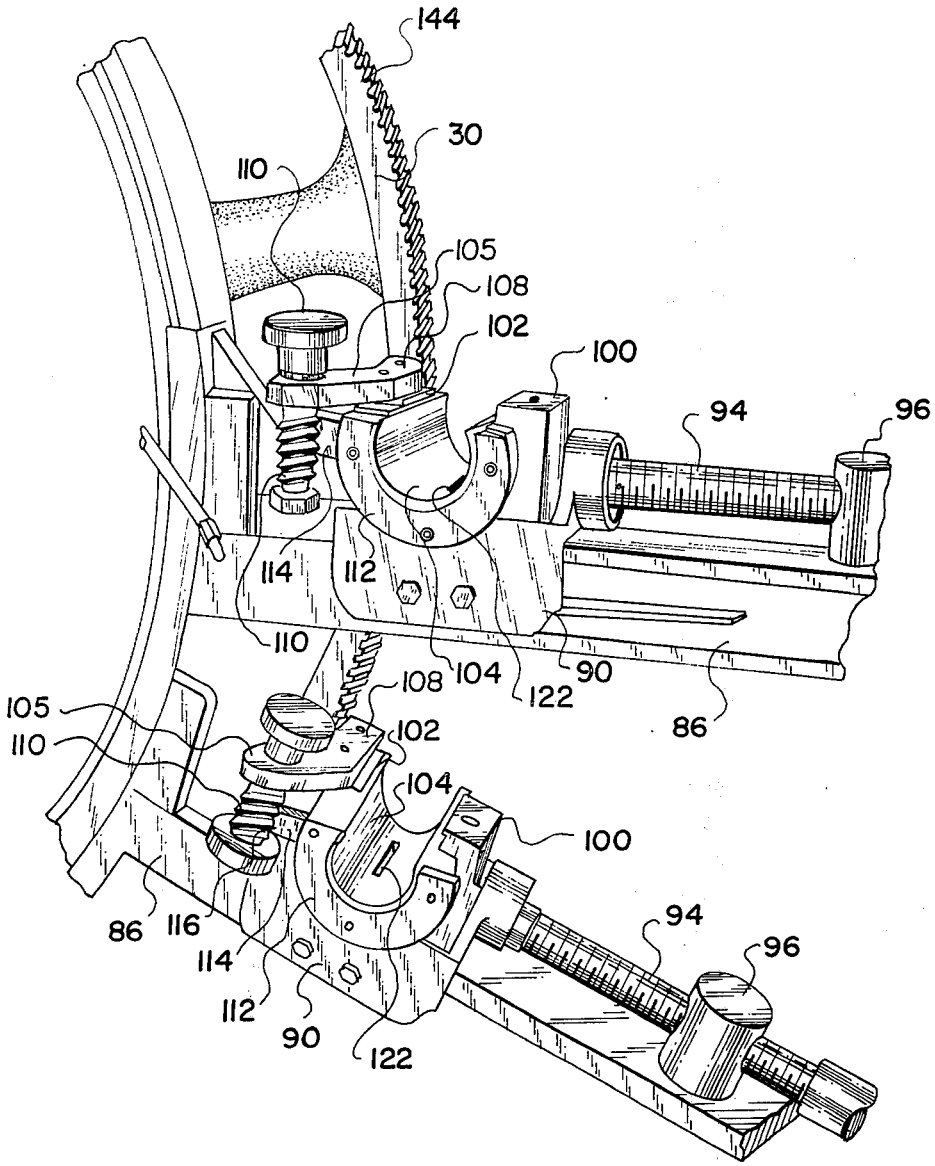
FIG. 6 is a partial view of a portion of the apparatus of the instant invention.
Figure 7:
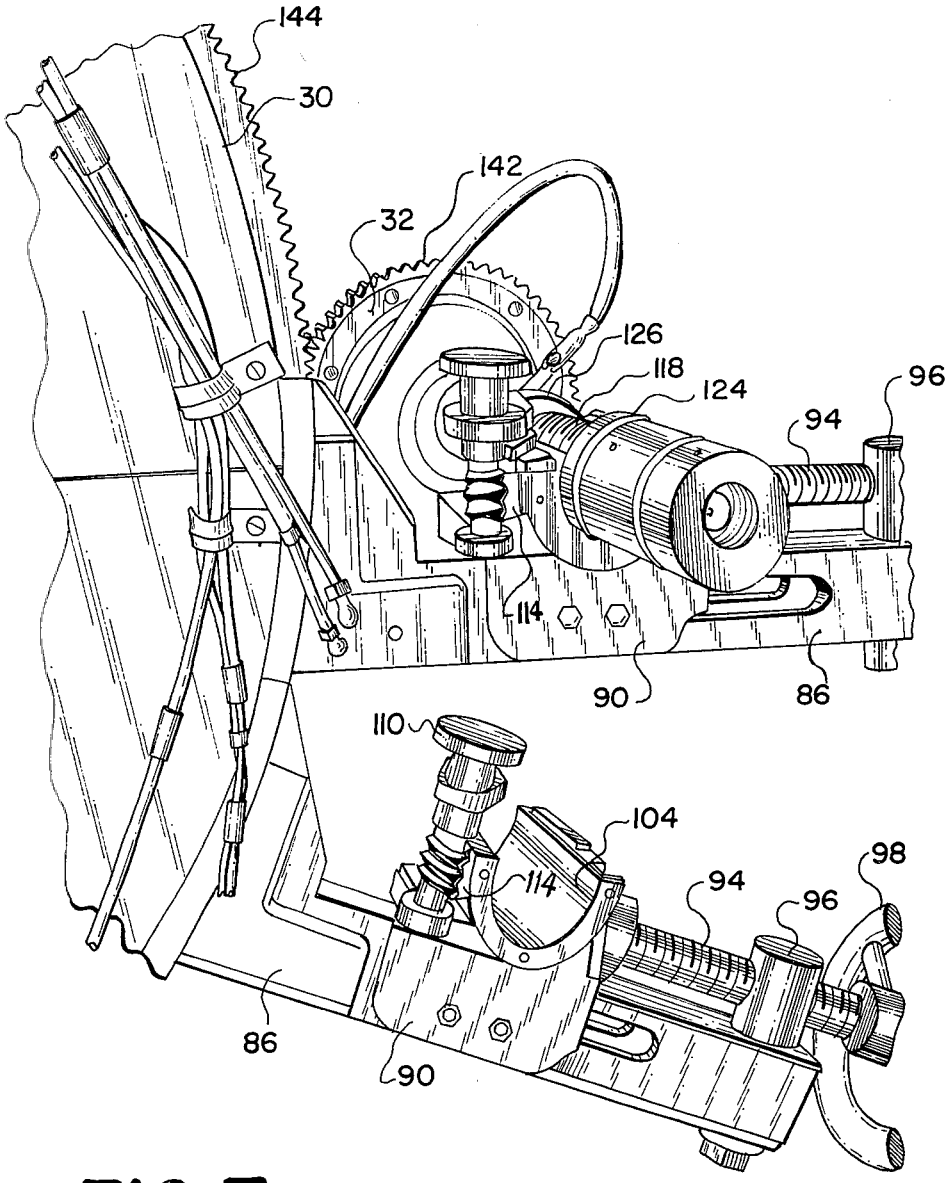
FIG. 7 is a partial perspective view similar to the view of FIG. 6 but illustrating the manner in which one of the novel rotary screen assemblies hereof is supported in adjustable relationship in respect to the frame.

As best seen in FIGS. 6 and 7, the carriage 90 includes upstanding wall portions 100, 102 which defines a receptacle for rotatable shaft holders 104 and 106 (holder 106 being visible in FIG. 1 only) which receive and carry the respective shaft members 40 and 42 which extend from opposite ends of the respective rotary screen assembly 24. For effecting rotation of holders 104, an arm 105 is secured to wall portion 102 by fastening means 108 with arm 105 having a screw threaded aperture at the end thereof through whcih passes an externally threaded adjusting screw 110. Secured on one face of the holder 104 there is a horseshoe shaped plate 112 having an extension 114, the teeth 116 of which are engaged by the teeth of the adjusting screw 110 in a worm and gear fashion. Rotation of the screw 110 causes corresponding rotation of holder 104.

As noted previously, the holders 104 and 106 of the rotary screen assembly 24 receive and support the respective shaft members 40 and 42 extending from opposite ends of the inner elongated support member 36 of the rotary screen assembly 24. As best seen in FIGS. 2 and 5, a portion 118 of the respective shaft members 40 and 42 is externally threaded and that same portion 118 includes an outwardly directed key 120 which is received in a somewhat longer keyway slot 122 provided in the rotatable holder 104 (FIG. 6). When the shaft members 40 and 42 are placed into the holders 104 and 106, it will be appreciated that the key and the keyway arrangement 120 and 122, respectively, drive the shaft member 40 for simultaneous rotation with the holder 104 while the longer length of the slot 122 with respect to the key 120 permits the shaft member 40 to be moved longitudinally with respect to the holder 104 for purposes which we will further describe. As best seen in FIG. 5, a pair of internally threaded adjusting nuts 124 and 126 are threaded on portion 118 of shaft 40 and may be tightened up against the plate 112 and the rear end of holder 104.

From the above, it can be seen that by rotating the adjusting screws 110, the holder 104 (shaft member 40 and the inner elongated member 36, together with the block 38) will be rotated to vary the angular position of the squeegee 56 with respect to the inner surface of the screen 26. As is well known, varying the angle of the squeegee 56 varies the degree to which the squeegee forces paste or coloring ink through the finely apertured pattern provided in the screen 26 as it rotates past the squeegee edge and is a useful and desirable adjustment feature. In accordance with the instant invention, the aforedescribed arrangement makes possible selective angular change of the squeegee 56 from a point outside of the screen 26.

Also suggested above, is the fact that the instant invention may include adjusting means for effecting longitudinal motion of the rotary assemblies 24 with respect to the backing drum 20. In the instant invention, this is effected in a most simple and advantageous manner by utilization of the aforedescribed internally threaded adjusting nuts 124 and 126 in the following manner. Specifically, and with reference to FIG. 5, let it be assumed that it is necessary to move the screen assembly 24 to the right. One merely has to rotate adjusting nut 124 a few turns so that it backs away from the plate 112 (FIG. 6), then rotate the adjusting nut 126. Since nut 126 cannot move to the left as viewed in FIG. 5 (because it abuts against holder 104), the entire shaft member 40 and the remainder of the screen assembly 24 will, therefore, move longitudinally to the right. In like fashion, if it is necessary to move screen assembly 24 to the left, one merely unloosens adjusting nut 126 and rotates adjusting nut 124. Since this adjusting nut 124 cannot move to the right, the entire shaft member 40 together with the rotary screen assembly 24, must then move to the left.

In accordance with the invention, it is also possible to move the individual screen assembly 24 circumferentially (i.e., up or down) with respect to the back-up drum 20 to get the pattern in register. As it will be understood, moving the screen assembly 24 circumferentially with respect to the back-up drum 20 will vary the relation of the pattern tangentially on the respective hollow screen 26 with respect to the drum. With respect to FIG. 5, the aforementioned gear 32 is capable of both rotation and longitudinal motion with respect to the shaft member 40 by virtue of ball bearings 130 and 132. Gear member 32 is provided with at least one through passageway 134 which freely receives an elongated pin 136 having a threaded reduced diameter neck portion 138 which passes through end plate 48 engaging with nut 140. Thus, rotation of the gear 132 in response to rotation of the main gear member 30 will be transmitted by pin 136 to rotate the plate 48 and screen 26 about the inner elongated support member 36.

As it can best be appreciated by considering FIG. 2 and FIG. 6, the gear teeth of the gear member 32 are helically oriented as are the corresponding teeth 144 of the main gear 30 which teeth 144 are substantially longer than the corresponding teeth 142 of each assembly 24. Thus, should the individual gear member 32 be longitudinally moved along the shaft 40, the coaction of the helically oriented teeth 142 and 144 will cause not only longitudinal motion, but also a certain degree of vertical motion (depending on which way the gear member 32 moves along the shaft member 40). As stated, in other words, the helical pitch of the threads 142 and 144 cause vertical motion of the gear member 32 (in or out of the plane of the paper upon which FIG. 5 is drawn) as well as corresponding longitudinal motion. Of course, the longitudinal motion of gear member 32 has no effect on the end plate 48 or the screen 26 (because of the freely sliding motion of the pin 136 in the passageway 134) but, the vertical motion of the gear member 32 causes the entire screen assembly 24 to move tangentially up or down with respect to the backing drum 20, thereby permitting a variation in the tangential relation of the patten on the hollow screen 26 with respect to the back-up drum 20.

To effect the desired longitudinal motion of the gear 32, it was previously mentioned that the shaft member 40 include a hollow interior 44 which is internally threaded. Shaft member 40 also includes a transverse elongated passageway 146, the purpose of which will be explained. Provided within the interior 44 of the shaft member 40 is an externally threaded shaft 148 which transversely carries a pin 150 therethrough. As seen in FIG. 5, the opposite ends of pin 150 pass through the elongated passageway 146 and into engagement with the hub portion 152 of the gear 32. Thus, rotation of the externally threaded shaft 148 within the internally threaded interior 44 of the outer shaft member 40 will longitudinally move the pin 150 (and hence the gear 32) to the right or left as viewed in FIG. 5 depending upon the direction of rotation. To effect such rotation, there is provided at the left most end of the shaft member 40 of FIG. 5 a rotatable knob 154 which includes a cylindrical portion 156 which is secured to theshaft 148. This cylindrical portion includes a step shoulder 158 which may engage a ball bearing 160 which is retained in position by retaining ring 164 held by sleeve 166. Thus, by rotating the knob 154, the externally threaded shaft 148 is rotated with respect to the mating internally threaded interior 44 of the shaft member 40 to effect the desired longitudinal motion of the shaft 148. As noted, this longitudinal motion is transmitted by pin 150 to the gear member 32 and causes the helically oriented teeth 142 and 144 to move the gear 32 vertically as well as longitudinally. By virtue of the freely sliding pin 136, the vertical motion of the gear 32 is accompanied by vertical motion of inner elongated member 36 and the screen 26 while the horizontal motion of the gear 32 effects no horizontal motion of the screen 26 and the support member 36 about which it rotates.

Figure 8:
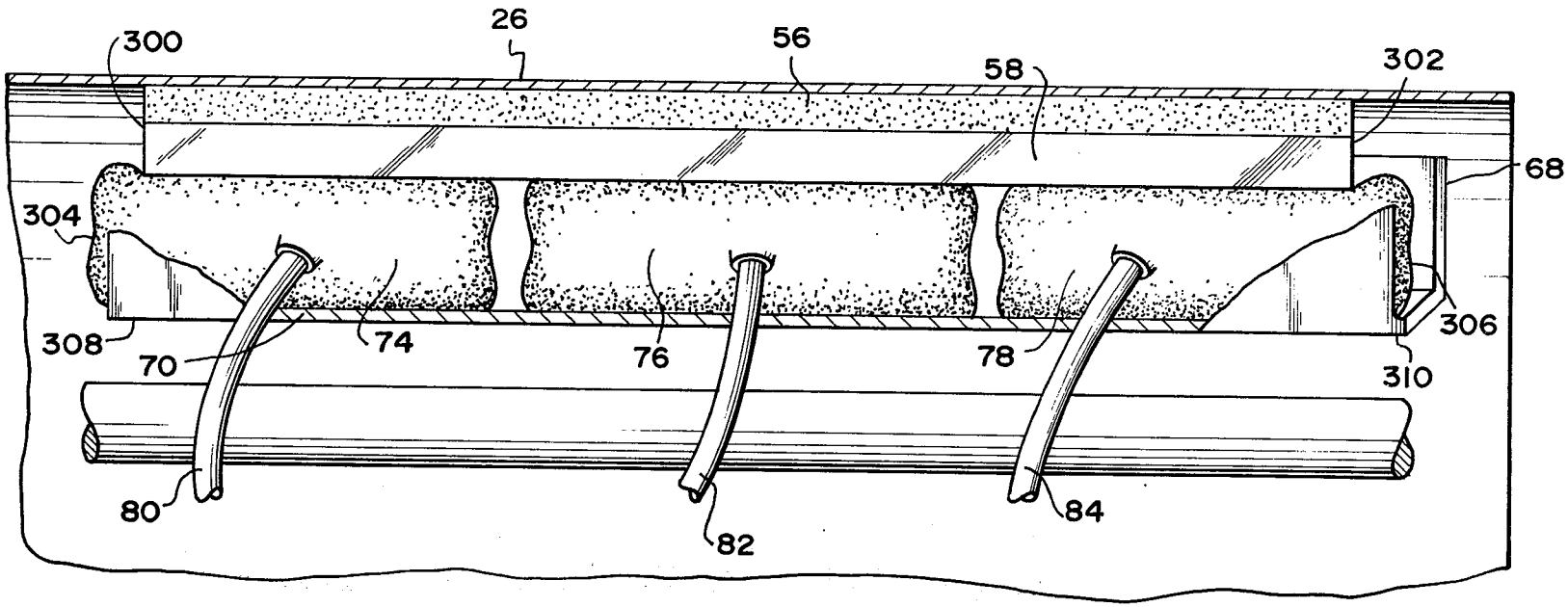
FIG. 8 is a side view, partially in perspective and partially in section, illustrating an improvement of the instant invention in which the individually inflatable tubes extend beyond the ends of the elongated squeegee.

The embodiment illustrated in FIG. 8 represents an alternative embodiment with respect to the embodiment initially discussed and disclosed with respect to FIG. 4. In the embodiment of FIG. 8, the squeegee 56 and squeegee holder 58 terminate at first and second ends 300 and 302, respectively, and the outermost tubes 74 and 78 extend beyond such ends. In this manner, and as illustrated in FIG. 8, when tubes 74 and 78 are inflated, they become somewhat overinflated at their respective end portions 304 and 306. This overenlargement of the ends 304 and 306 guarantees that the respective ends 300 and 302 of the squeegee will be firmly and properly engaged with the inner periphery of the screen and compensates for any tendency of the ends of the squeegee to separate from the screen. It should be noted that the U-shaped channel 68 is also extended in the embodiment of FIG. 8 to provide support regions 308 and 310 for the portions 304 and 306 of the bags 74 and 78.

Above has been described the rotary screen printing machine which includes a plurality of individually inflatable tubes to selectively vary the pressure which is supplied to different portions of the length of the squeegee while at the same time such machine includes a simple adjusting mechanism which makes it possible for (1) angular adjustment of the squeegee from a location outside of the hollow screen associated therewith; (2) longitudinal motion of the rotary screen assembly with respect to its back-up member; and (3) circumferential adjustment of the rotary screen assembly with respect to the back-up member.

What is claimed:

1. A screen printing machine comprising:

a frame;

backing means supported by said frame to provide a support surface for material;

at least one rotary screen assembly carried by said frame in adjustably spaced relationship with respect to said support surface; said rotary screen assembly comprising:

an inner elongated support;

an outer hollow screen rotatably supported about said inner elongated support for rotation about an axis defined thereby;

elongated applicator means engaging the inner surface of said screen and supported by said elongated inner support;

and further including pressure adjusting means in the interior of said hollow screen, said pressure adjusting means comprising a plurality of axially spaced, individually inflatable elongated tubes positioned between said inner elongated support and said elongated applicator means for selectively urging said applicator means toward the inner periphery of said screen, whereby pressure applied to said applicator means may be selectively varied along the length thereof.

2. The screen printing machine of claim 1 wherein said plurality of inflatable tubes comprises three inflatable tubes.

3. The screen printing machine of claim 1 and further including biasing means interposed between said elongated applicator means and said inner elongated support for urging said elongated applicator means and said inner elongate support toward one another.

4. The screen printing machine of claim 1 wherein said rotary screen assembly further includes a generally U-shaped channel member carried by said inner support, said channel member having a base portion and upstanding side walls extending toward said inner periphery of said screen; said tubes positioned within the confines of said channel member between said applicator means and said base portion; and further including biasing means normally urging said applicator means toward said base portion of said channel member against said tubes.

5. The screen printing machine of claim 1 wherein said elongated applicator means has first and second ends; at least one of said tubes extending beyond said first end.

6. The screen printing machine of claim 5 wherein a second one of said tubes extends beyond said second end of said elongated applicator means.

7. A screen printing machine comprising:

a frame;

backing means supported by said frame to provide a support surface for material;

at least one rotary screen assembly carried by said frame in adjustably spaced relationship with respect to said support surface; said rotary screen assembly comprising:

an inner elongated support;

an outer hollow screen rotatably supported about said inner elongated support for rotation about an axis defined thereby;

elongated applicator means engaging the inner surface of said screen and supported by said elongated inner support;

further including first and second shaft members exending from opposite ends of said inner elongated support;

first and second holders carried by said frame for supporting said first and second shaft members;

further including first adjusting means for rotating said inner elongated support about its said axis from a location outside of said hollow screen;

wherein said first adjusting means includes selectively operable means for rotating at least one of said first and second holders and wherein said at least one holder includes an elongated slot therein and said respective shaft member including an outstanding key member which is removably received in said slot; said slot being longer than said key member whereby said key member, said inner support and screen are capable of axial motion with respect to said at least one holder while said respective shaft member is keyed thereto for rotation therewith;

and further including second adjusting means for effecting longitudinal motion of said respective shaft member with respect to said one holder.

8. The screen printing machine of claim 7 wherein said frame includes first and second outstanding projections; said first and second holders being carried on saddle members movably positionable with respect to said projections.

9. The assembly of claim 7 and further including pressure adjusting means in the interior of said hollow screen, said pressure adjusting means comprising a plurality of longitudinally spaced, individually inflatable elongated tubes positioned between said inner elonaged support and said elongated applicator means for selectively urging said applicator means toward the inner periphery of said screen, whereby pressure applied to said applicator means may be selectively varied along the length thereof.

10. The screen printing machine of claim 9 wherein said support surface comprises a rotary drum mounted on a main shaft, and further comprisisng a sun gear mounted on said main shaft, said sun gear having helically oriented teeth circumferentially thereabout; and further including third adjusting means cooperating with said helically oriented teeth for effecting circumferential movement of said hollow screen with respect to said rotary drum.

11. The screen printing machine of claim 10, said third adjusting means comprising a gear rotatably and slidably supported on one of said first and second shaft members, said gear having helically oriented teeth which engage said helically oriented teeth of said sun gear;

connecting means interconnecting said gear and said hollow screen for effecting simultaneous rotation of same while allowing free axial motion of said gear along said one shaft member;

selectively operable means for effecting axial motion of said gear to thereby effect circumferential movement of said screen with respect to said drum.

12. A screen printing machine comprising:

a frame;

backing means supported by said frame to provide a support surface for material;

at least one rotary screen assembly carried by said frame in adjustably spaced relationship with respect to said support surface; said rotary screen assembly comprising;

an inner elongated support;

an outer hollow screen rotatably supported about said inner elongated support for rotation about an axis defined thereby;

elongated applicator means engaging the inner surface of said screen and supported by said elongated inner support;

further including first and second shaft members extending from opposite ends of said inner elongated support;

first and second holders carried by said frame for supporting said first and second shaft members;

and further including first adjusting means for rotating said inner elongated support about its said axis from a location outside of said hollow screen;

wherein said first adjusting means includes selectively operable means for rotating at least one of said holders and means for keying said one holder to its associated shaft member for simultaneous rotation;

wherein one of said shaft members is externally threaded along a portion thereof, said portion being greater in length than the length of its associated holder;

and further including second adjusting means for effecting axial motion of said inner elongated support, whereby the axial position of said screen with respect to said support surface is adjustably positioned;

said second adjusting means comprising a pair of internally threaded adjustment rings, said rings threadably engaging said portion on opposite sides of said associated holder.

13. The assembly of claim 12 wherein aid support surface comprises a rotary drum mounted on a main shaft and further comprising a sun gear mounted on said main shaft, said sun gear having helically oriented teeth circumferentially thereabout; and further including third adjusting means for effecting circumferential movement of said hollow screen with respect to said rotary drum; said third adjusting means including;

a gear rotatably and slidably supported on one of said first and second shaft members, said gear having helically oriented teeth which engage said helically oriented teeth of said sun gear;

connecting means interconnecting said gear and said hollow screen for effecting simultaneous rotation of same while allowing free axial motion of said gear along said one shaft member; and selectively operable means for effecting axial motion of said gear to thereby effect circumferential movement of said screen with respect to said drum.

14. A screen printing machine comprising:

a frame;

backing means supported by said frame to provide a support surface for material;

at least one rotary screen assembly carried by said frame in adjustably spaced relationship with respect to said support surface said rotary screen assembly comprising;

an inner elongated support;

an outer hollow screen rotatably supported about said inner elongated support for rotation about an axis defined thereby;

elongated application means engaging the inner surface of said screen and supported by said elongated inner support;

further including first and second shaft members extending from opposite ends of said inner elongated support to locations outside of said hollow screen;

first and second holders carried by said frame for supporting said first and second shaft members; and wherein one of said shaft members is externally threaded along a portion thereof, said portion being greater in length than the length of its associated holder;

and further including adjusting means for effecting axial motion of said inner elongated support, whereby the axial position of said screen with respect to said support surface may be adjustably positioned;

said adjusting means comprising a pair of internally threaded adjustment rings; said rings threadably engaging said portion on opposite sides of said associated holder.

15. The assembly of claim 14 wherein said frame includes first and second outstanding proojecitons; said first and second holders being carried on saddle members movably positionable with respect to said projections. projections;

16. A screen printing machine comprising:

a frame;

backing means supported by said frame, to provide a support surface for material;

at least one rotary screen assembly carried by said frame in adjustably spaced relationship with respect to said support surface; said rotary screen assembly comprising;

an inner elongated support;

an outer hollow screen rotatably supported about said inner elongated support for rotation about an axis defined thereby;

elongated applicator means engaging the inner surface of said screen and supported by said elongated inner support;

and further including first adjusting means for rotating said inner elongated support about its said axis from a location outside of said hollow screen;

and further including second adjusting means for effecting axial motion of said inner elongated support, whereby the axial position of said screen with respect to said support surface is adjustably positioned;

further including first and second shaft members extending from opposite ends of said inner elongated support;

first and second holders carried by said frame for supporting said first and second shaft members;

wherein said support surface comprises a rotary drum mounted on a main shaft, and further comprising a sun gear mounted on said main shaft, said sun gear; having helically oriented teeth circumferentially thereabout; and further including third adjusting means for effecting circumferential movement of said hollow screen with respect to said rotary drum; said third adjusting means comprising;

a gear rotatably and slidably supported on one of said first and second shaft members, said gear having helically oriented teeth which engage said helically oriented teeth of said sun gear;

connecting means interconnecting said gear and said hollow screen for effecting simultaneous rotation of same while allowing free axial motion of said gear along said one shaft member;

selectively operable means for effecting axial motion of said gear to thereby effect circumferential movement of said screen with respect to said drum;

wherein said hollow screen is supported about said elongated support by first and second end plates freely rotatable with respect to said first and second shaft members and prevented from axial motion therealong; and wherein said connecting means includes at least one elongated pin member passing freely through said gear and fixed with respect to one of said first and second end plates.

17. The screen printing machine of claim 16 wherein said one of said shaft members is hollow and additionaly includes an elongated passageway therethrough located adjacent the portion of said one shaft member on which said gear is situated; said selectively operable means for effecting axial motion of said gear including an elongated shaft axially movable within said one shaft member and pin means passing through said elongated passageway for connecting said elongated shaft to said gear.

18. A screen printing machine comprising:

a frame;

backing means supported by said frame to provide a support surface for material;

at least one rotary screen assembly carried by said frame in adjustably spaced relationshp with respect to said support surface; said rotary screen assembly comprising;

an inner elongated support;

an outer hollow screen rotatably supported about said inner elongated support for rotation about an axis defined thereby;

elongated applicator means engaging the inner surface of said screen and supported by said elongated inner support;

and further including first adjusting means for rotating said inner elongated support about its said axis from a location outside of said hollow screen;

and further including second adjusting means for effecting axial motion of said inner elongated support; whereby the axial position of said screen with respect to said support surface is adjustably positioned;

further including first and second shaft members extending from opposite ends of said inner elongated support;

first and second holders carried by said frame for supporting said first and second shaft members;

wherein support surface means comprises a rotary drum mounted on a main shaft, and further comprising a sun gear mounted on said main shaft, said sun gear having helically oriented teeth circumferentially thereabout; and further including third adjusting means for effecting circumferential movement of said hollow screen with respect to said rotary drum; said third adjusting means comprising;

a gear rotatably and slidably supported on one of said first and second shaft members, said gear having helically oriented teeth which engage said helically oriented teeth of said sun gear;

connecting means interconnecting said gear and said hollow screen for effecting simultaneous rotation of same while allowing free axial motion of said gear along said one shaft member;

selectively operable means for effecting axial motion of said gear to thereby effect circumferential movement of said screen with respect to said drum; and wherein said one of said shaft members is hollow and additionally includes an elongated passageway therethrough located adjacent the portion of said one shaft member on which said gear is situated; said selectively operable means for effecting axial motion of said gear including an elongated shaft axially movable within said one shaft member, and pin means passing through said elongated passageway for connecting said elongated shaft to said gear.

19. The screen printing machine of claim 18 wherein the hollow interior of said one shaft member is internally threaded and said elongated shaft is externally threaded and maintained in threaded engagement with said interior.

20. A screen printing machine comprising:

a frame;

backing means supported by said frame to provide a support surface for material;

at least one rotary screen assembly carried by said frame in adjustably spaced relationship with respect to said support surface; said rotary screen assembly comprising;

an inner elongated support;

an outer hollow screen rotatably supported about said inner elongated support for rotation about an axis defined thereby;

elongated applicator means engaging the inner surface of said screen and supported by said elongated inner support;

and further including first adjusting means for rotating said inner elongated support about its own longitudinal axis;

wherein said support surface comprises a rotary drum mounted on a main shaft, and further comprising a sun gear mounted on said main shaft, said sun gear having helically oriented teeth circumferentially thereabout; and further including circumferential adjusting means for effecting circumferential movement of said hollow screen with respect to said rotary drum;

further including first and second shaft members extending from opposite sides of said inner elongated support; said circumferential adjusting means comprising:

a gear rotatably and slidably supported on one of said first and second shaft members, said gear having helically oriented teeth which engage said helically oriented teeth of said sun gear;

connecting means interconnecting said gear and said hollow screen for effecting simultaneous rotation of same while allowing free axial motion of said gear along said one shaft member; and selectively operable means for effecting axial motion of said gear to thereby effect circumferential movement of said screen with respect to said drum;

wherein said hollow screen is supported about said elongated support by first and second end plates freely rotatable with respect to said first and second shaft members and prevented from axial motion therealong; and wherein said connecting means includes at least one elongated pin member passing freely through said gear and fixed with respect to one of said first and second end plates.

21. The screen printing machine of claim 20 wherein said one of said shaft members is hollow and additionally includes an elongated passageway therethrough located adjacent the portion of said one shaft member on which said gear is situated; said selectively operable means for effecting axial motion of said gear including elongated shaft axially movable within said one shaft member, and pin means passing through said elongated passageway for connecting said elongated shaft to said gear.

22. A screen printing machine comprising:

a frame;

backing means supported by said frame to provide a support surface for material;

at least one rotary screen assembly carried by said frame in adjustably spaced relationship with respect to said support surface; said rotary screen assembly comprising;

an inner elongated support;

an outer hollow screen rotatably supported about said inner elongated support for rotation about an axis defined thereby;

elongated applicator means engaging the inner surface of said screen and supported by said elongated inner support; and wherein said support surface comprises a rotary drum mounted on a main shaft, and further comprising a sun gear mounted on said main shaft, said sun gear having helically oriented teeth circumferentially thereabout;

and further including first and second shaft members extending from opposite sides of said inner elongated support;

further including adjusting means for effecting circumferential movement of said hollow screen with respect to said rotary drum; said adjusting means comprising:

a gear rotatably and slidably supported on one of said first and second shaft members, said gear having helically oriented teeth which engage said helically oriented teeth of said sun gear;

connecting means interconnecting said gear and said hollow screen for effecting simultaneous rotation of said screen while allowing free axial motion of said gear along said one shaft member; and selectively operable means for effecting axial motion of said gear to thereby effect circumferential movement of said screen with respect to said drum;

wherein said hollow screen is supported about said elongated support by first and second end plates freely rotatable with respect to said first and second shaft members and prevented from axial motion therealong; and wherein said connecting means includes at least one elongated pin member passing freely through said gear and fixed with respect to one of said first and second end plates.

23. The screen printing machine of claim 22 wherein said one of said shaft members is hollow and additionaly includes an elongated passgeway therethrough located adjacent the portion of said one shaft member on which said gear is situated; said selectively operable means for effecting axial motion of said gear including an elongated shaft axially movable within said one shaft member, and pin means passing through said elongated passageway for connecting said elongated shaft to said gear.

* * * * *